US005791544A

United States Patent [19]

Fujimaki

[11] Patent Number: 5,791,544

[45] Date of Patent: Aug. 11, 1998

[54] ELECTRIC STAPLER

[75] Inventor: Fumio Fujimaki, Ibaraki, Japan

[73] Assignee: Riso Kagaku Corporation, Tokyo, Japan

[21] Appl. No.: 970,387

[22] Filed: Nov. 14, 1997

[51] Int. Cl.[6] ..... B25C 1/04

[52] U.S. Cl. ..... 227/7; 227/131

[58] Field of Search ..... 227/5, 6, 7, 131, 227/154, 156, 140

[56] References Cited

U.S. PATENT DOCUMENTS

| | | | |
|---|---|---|---|
| 4,795,071 | 1/1989 | Jacobs et al. | 227/7 |
| 5,427,296 | 6/1995 | Chen | 227/7 |
| 5,595,336 | 1/1997 | Everdyke | 227/7 |
| 5,657,918 | 8/1997 | Shimomura et al. | 227/7 |

*Primary Examiner*—Scott A. Smith
*Attorney, Agent, or Firm*—Sughrue, Mion, Zinn, Macpeak & Seas, PLLC

[57] ABSTRACT

An electric stapler in which sheets conveyed along the sheet guide surface are staplied in a stapling position on a sheet guide surface, the electric stapler comprises: a switch; a staple unit for stapling the sheets in the stapling position in response to the switch; a first actuator protruding in part from the sheet guide surface, wherein, when the first actuator brings into contact with more than one place of one edge side of the sheets conveyed beyond the stapling position and moved by the sheets being conveyed, the first actuator actuates the switch so as to operate the stapling unit; and a second actuator positioned upstream the first actuator, a part of the second actuator selectively projecting and retracting with respect to the sheet guide surface, wherein, when the second actuator brings into contact with predetermined lengths of different edge sides constituting a corner portion of the sheets being conveyed beyond the stapling position while the part protruding from the sheet guide surface and moved by the sheets being conveyed, the second actuator actuates the switch so as to operate the stapling unit.

6 Claims, 6 Drawing Sheets

ELECTRIC STAPLER

BACKGROUND OF THE INVENTION

The present invention relates to an electric stapler for binding a bundle of sheets (designating any kind of thing such as sheets of printing paper, irrespective of the kind of the material) by the use of staples and more particularly to an electric stapler capable of driving staples into a bundle of sheets not only in parallel ("a parallel stapling", when applicable) but also obliquely ("an oblique stapling").

A conventionally known electric stapler used for binding a bundle of sheets is equipped with a casing having a narrow slit for receiving such a bundle of sheets. Moreover, an actuator is provided in the casing inside the slit, so that the actuator is able to move the bundle of sheets after being brought into contact with the edge side of the bundle of sheets. The actuator is equipped with a pair of guide members for guiding the edge side of the bundle of sheets. The pair of guide members are set apart from each other by a predetermined space along a direction perpendicular to the direction in which the bundle of sheets is inserted. The pair of guide members are brought into contact with the edge side of the bundle of sheets at two places. A stapling unit as a stapling means for binding the bundle of sheets inserted through the slit is installed in the casing inside the slit. The operation of the stapling unit is interlocked with that of the actuator.

A method of binding a bundle of sheets by means of an electric stapler differs according to the position where a staple is driven into the bundle of sheets. By "parallel stapling" is meant that by inserting one edge side of a bundle of sheets through the slit of the stapler along a direction perpendicular to the direction of the edge side, a staple is then driven-in parallel to and in the proximity of the edge side. By "oblique stapling" is meant that the corner portion of a bundle of sheets is inserted through the slit of the stapler and a staple is then driven into the corner portion of the bundle in such a way that the staple is positioned obliquely with respect to the two edge sides thereof putting the corner portion therebetween.

When the parallel stapling is conducted, the guide members of the actuator are brought into contact with the respective two places of the one edge side of the bundle of sheets inserted through the slit. As the bundle of sheets is inserted deeper, the actuator is pushed and moved by the bundle of sheets, thus causing a switch to operate. Thus, the stapling unit is operated, so that parallel stapling stapling is provided for the bundle of sheets.

In the above-described conventional ordinary electric stapler, the pair of guide members of the actuator function as those which are brought into contact with the one edge side of the bundle of sheets set perpendicular to the direction in which the bundle of sheets is inserted and used to guide the sheet member to a predetermined position where the parallel stapling is conducted when the bundle of sheets in the predetermined parallel stapling position is inserted through the slit.

When it is attempted to provide the oblique stapling for a bundle of sheets by means of such an electric stapler, the two edge sides thereof putting its corner portion therebetween cannot be brought into contact with the actuator in that position of the bundle of sheets even when the predetermined position of the corner portion of the bundle of sheets reaches the stapling unit of the electric stapler; consequently, the stapling unit remains unoperational. If one tries to insert the bundle of sheets through the slit deeper up to a position where the two edge sides are brought into contact with the guide members of the actuator, a staple would be driven-in obliquely in a position far from the predetermined position of the corner portion of the bundle of sheets.

In order to make the oblique stapling possible, a manual push button switch for operating an electric stapler may be installed separately to carry out the oblique stapling by pushing the bottom switch after properly inserting the corner portion of a bundle of sheets through the slit of the stapler. However, stapling is hardly provided in the desired position of the corner portion of the bundle of sheets in this case.

For the reason stated above, a special adaptor has heretofore been fitted to an electric stapler in a case where an electric stapler of the sort mentioned above is used to drive a staple obliquely into a bundle of sheets. When the parallel stapling and the oblique stapling is successively employed, however, the adaptor has to be detached or attached each time the stapling method is changed and this results in troublesome operation. Moreover, there is still a problem arising from the missing of the adaptor that has been detached.

Further, one of the known electric staplers is fitted with an actuator on this side close to a stapling unit positioned deeper in the slit of a casing, the actuator being in such a form that it is selectively usable for the parallel stapling and the oblique stapling. When such an electric stapler is used to provide the oblique stapling, however, guide members for guiding the bundle of sheets to a predetermined stapling unit position appear to improperly function because a position where a bundle of sheets is brought into contact with the actuator is short. In consequence, it is hardly possible to provide stapling in the predetermined position of the bundle of sheets.

SUMMARY OF THE INVENTION

In view of the foregoing problems, an object of the present invention is to provide an electric stapler so designed that one state in which a staple can be driven into a bundle of sheets in parallel thereto is switchable through an extremely simple operation over to a state in which a staple can be driven into a bundle of sheets obliquely.

According to a first aspect of the present invention, there is provided an electric stapler for stapling the sheets, comprising: staple means having a sheet guide surface on which the sheets are conveyed, for stapling the sheets thus conveyed in a stapling position; a first actuator protruding in part from the sheet guide surface, having a switch wherein, when the first actuator brings into contact with more than one place of one edge side of the sheets conveyed beyond the stapling position and moved by the sheets being conveyed, the first actuator actuates the switch so as to operate the stapling means; and a second actuator positioned upstream the first actuator, the part of the second actuator selectively projecting and retracting with respect to the sheet guide surface, having a switch wherein, when the second actuator brings into contact with predetermined lengths of different edge sides constituting a corner portion of the sheets being conveyed beyond the stapling position while the part protruding from the sheet guide surface and moved by the sheets being conveyed, the second actuator actuates the switch so as to operate the stapling means.

According to a second aspect of the invention, there is provided the electric stapler of the first aspect, wherein a common switch is used for the switch of the first actuator and the switch of the second actuator.

According to a third aspect of the invention, there is provided the electric stapler of the second aspect, wherein the second actuator has blocking means for preventing the first actuator from actuating the common switch during the part of the second actuator protrudes from the sheet guide surface.

According to a fourth aspect of the invention, there is provided the electric stapler of the first aspect, wherein the sheet guide surface has a sheet loading passage whose opening is vertically wide enough for stacked sheets having predetermined thickness to be inserted therethrough; and when the second actuator protrudes in part from the sheet guide surface, the second actuator blocks the sheet loading passage in the thickness direction of sheets to be inserted along the sheet loading passage.

According to a fifth aspect of the invention, there is provided the electric stapler of the first aspect, further comprising: a lever provided on an outside surface of the sheet guide surface, for switching positions of the second actuator with respect to the sheet guide, wherein the part of the second actuator is protruded from the sheet guide surface when the lever protrudes from an extending surface of the sheet guide surface, the part of the second actuator is not protruded from the sheet guide surface when the lever does not protrude from the extending surface of the sheet guide surface, and during the lever protruding from the extending surface of the sheet guide surface, an edge side of the sheets is brought into contact with the lever prior to the second actuator when the sheets are conveyed toward the second actuator such that the edge side is set substantially perpendicular to a conveying direction so as to prevent the switch from being actuated by the second actuator.

DETAILED DESCRIPTION OF THE PREFERRED EMBODIMENTS

A description will subsequently be given of an electric stapler embodying the present invention with reference to the accompanying drawings. Image forming apparatus such as copying machines and printing machines are used for recording images on sheets of paper and then discharging these sheets. An image forming apparatus of this sort is fitted with a sheet distribution unit called a "sorter." This sorter is also equipped with a distributing bin at a plurality of stages for successively receiving the recorded sheets and stacking them up. An electric stapler to be described according to this embodiment of the invention is provided for the sorter.

Figure 2:
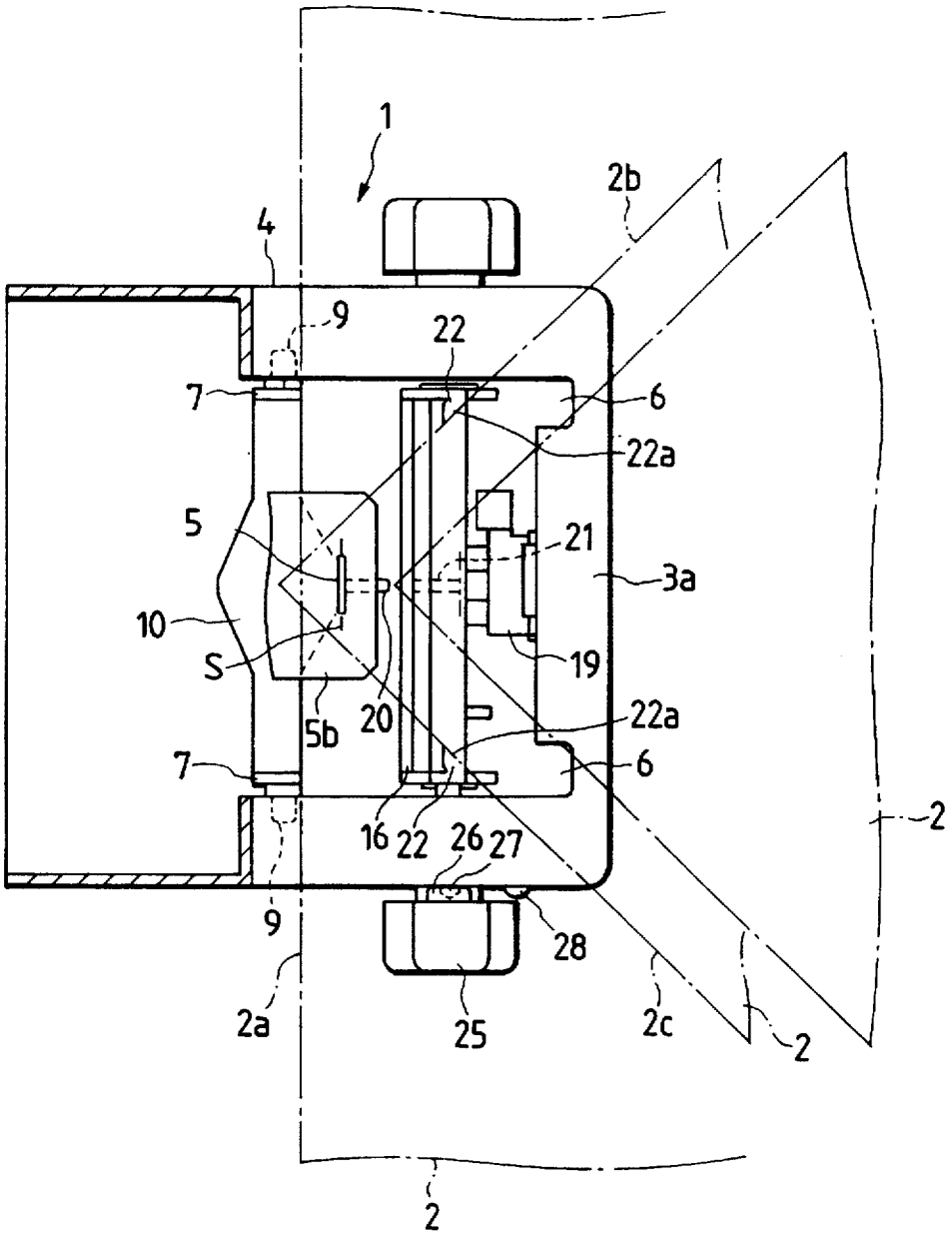
FIG. 2 is a sectional view thereof with a plane indicative of an arrangement on a bundle-of-sheets loading surface as a section.

As shown in FIG. 2, an electric stapler 1 is provided with a body frame 4. The body frame 4 is formed with a narrow slit 3 for receiving a bundle of sheets 2 to be subjected to stapling. In other words, the slit 3 is used as a sheet loading passage. The slit 3 is opened from the front of the body frame 4 toward both sidewalls and has a bundle-of-sheets loading surface 3*a* as a flat, horizontal sheet guide surface. An opening 6 is formed on the inner side of the bundle-of-sheets loading surface 3*a*.

At the bottom of the slit 3 is a stapling unit 5 as a stapling means and the stapling unit 5 has a movable hammer 5*a* and a stationary hammer 5*b*. The stationary hammer 5*b* is disposed at the bottom of the slit 3 and has a stapling position on the same surface as the bundle-of-sheets loading surface 3*a*, whereas the movable hammer 5*a* is disposed above the stationary hammer 5*b* with the slit 3 formed therebetween. During the stapling operation, the movable hammer 5*a* is lowered so as to clamp the bundle of sheets with the stationary hammer 5*b* and used to drive a staple in the predetermined position of the bundle of sheets.

A pair of parallel levers 7, 7 are provided in the body frame 4 and function as a first actuator for operating the stapling unit 5 at the time of parallel stapling. The upper end portions of the pair of parallel levers 7, 7 project upward via the opening 6 from the bundle-of-sheets loading surface 3*a* and are used to block the slit 3 in the vertical width direction thereof. The lower end portions of the parallel levers 7, 7 are coupled together by a coupling member 10 extending in a direction perpendicular to the paper surface in FIG. 3. Below the bundle-of-sheets loading surface 3*a*, the central portions of the parallel levers 7, 7 are each pivotally supported by shafts 9 with a direction perpendicular to the paper surface in FIG. 3 as an axial direction. The coupling member 10 is coupled to a retaining piece 4*a* provided in the body frame 4 with a coil spring 11, which urges the parallel levers 7, 7 clockwise in FIG. 3. The upper end portions of the parallel levers 7, 7 thus urged are moved toward the entrance of the slit 3. A cutout portion 12 is formed in each of the parallel levers 7, 7, and a retaining portion 13 engaging with the cutout portion 12 is formed in the body frame 4. Consequently, the parallel levers 7, 7 urged by the coil spring 11 are stopped at a position where the cutout portion 12 is brought into contact with the retaining portion 13, that is, at the position shown by a solid line of FIG. 3.

A pair of oblique levers 8, 8 are provided in the body frame 4 and function as a second actuator for operating the stapling unit 5 at the time of oblique stapling. The oblique levers 8, 8 are positioned closer to the entrance of the slit 3 than the parallel levers 7, 7. Oblique stapling guide members 22, 22 are provided at the upper ends of the oblique levers 8, 8 and have guide surfaces 22*a*, 22*a* which are brought into contact with predetermined lengths of two edge sides of the corner portion of the bundle of sheets inserted through the slit 3, respectively.

Figure 3:
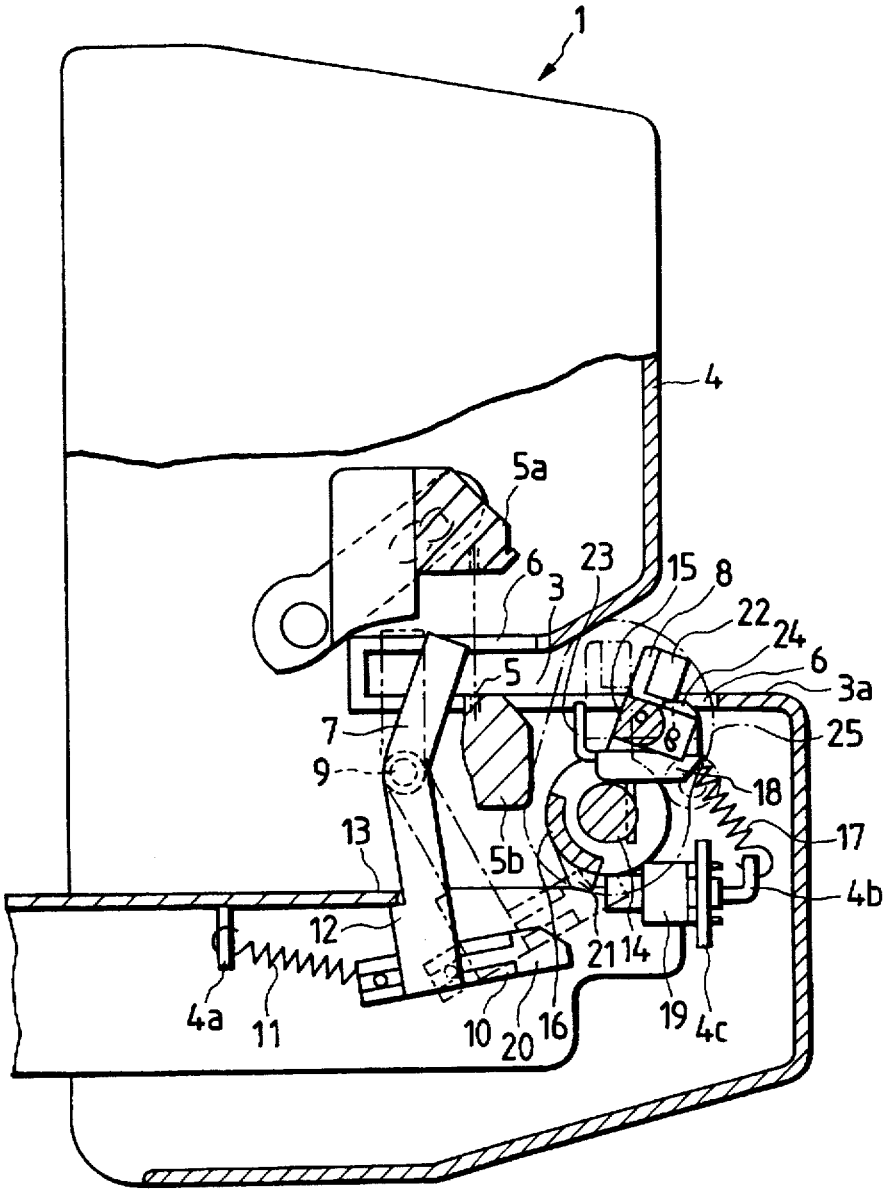
FIG. 3 is a sectional view thereof as viewed from the left-hand side with the oblique levers set in the upright position.
Figure 4:
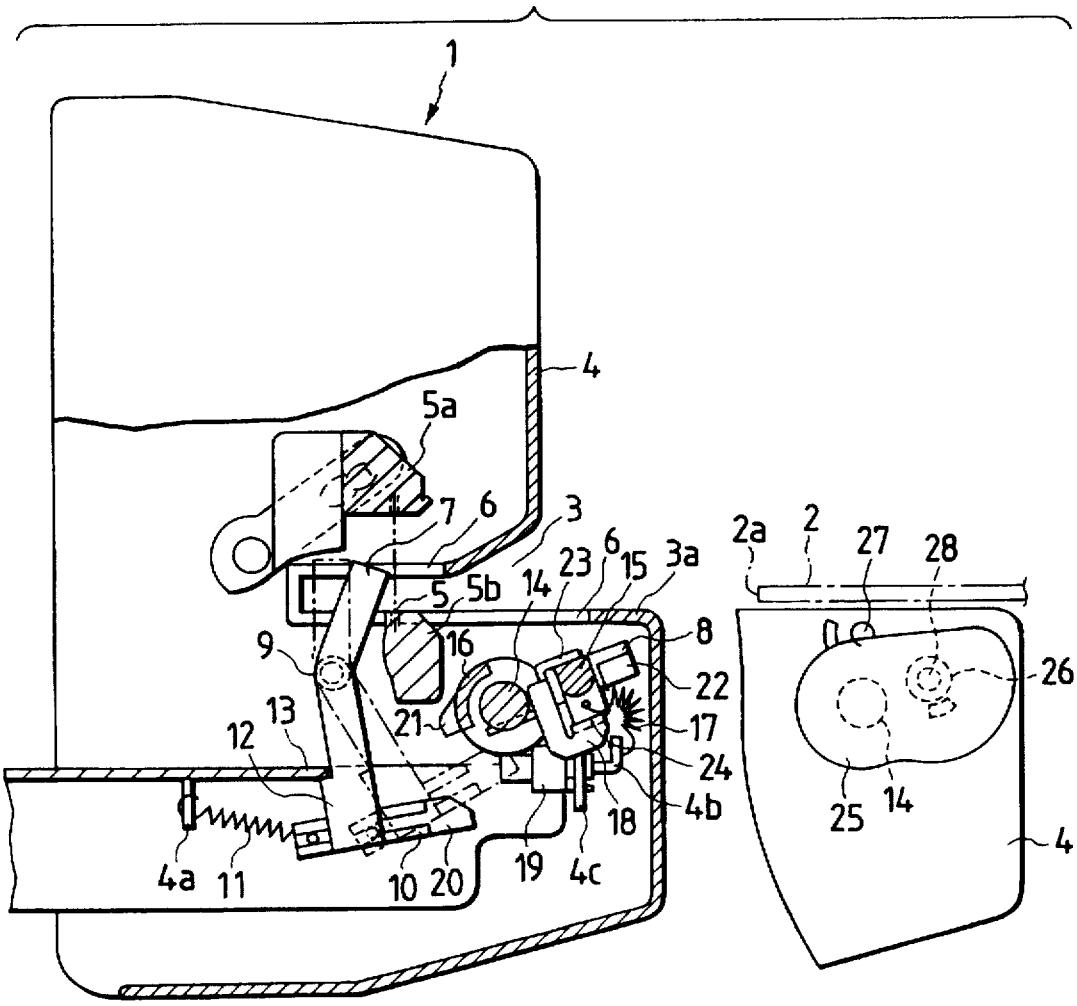
FIG. 4 is a sectional view thereof as viewed from the left-hand side with the oblique levers set in the turned-sidelong position together with part of the left side view thereof.

The oblique lever 8 shown in FIG. 3 is in an upright position and projects upward via the opening 6 from the bundle-of-sheets loading surface 3*a*. The oblique lever 8 in this state is brought into contact with the bundle of sheets inserted through the slit 3 and moved from a position shown by a solid line to what is shown by an imaginary line. The oblique lever 8 shown in FIG. 4 is in a turned-sidelong position and accommodated in the body frame 4 below the bundle-of-sheets loading surface 3*a*. The oblique lever 8 according to this embodiment of the invention can be switched from the upright position to the turned-sidelong position and vice versa through the operation of a changeover lever 25.

The oblique levers 8, 8 are coupled together by coupling members 15, 16 extending in a direction perpendicular to the paper surface in FIG. 3 below the bundle-of-sheets loading surface 3*a*, respectively. Each of the lower end portions of the oblique levers 8, 8 is pivotally supported by a shaft 14 with a direction perpendicular to the paper surface in FIG. 3 as its axial direction below the bundle-of-sheets loading surface 3*a*. The coupling member 15 is coupled to a coil spring 17 with respect to a retaining piece 4*b* provided in the body frame 4. The coil spring 17 urges the oblique levers 8, 8 clockwise in FIG. 3 and the upper end portions of the oblique levers 8, 8 thus urged are moved toward the entrance of the slit 3.

Figure 5:
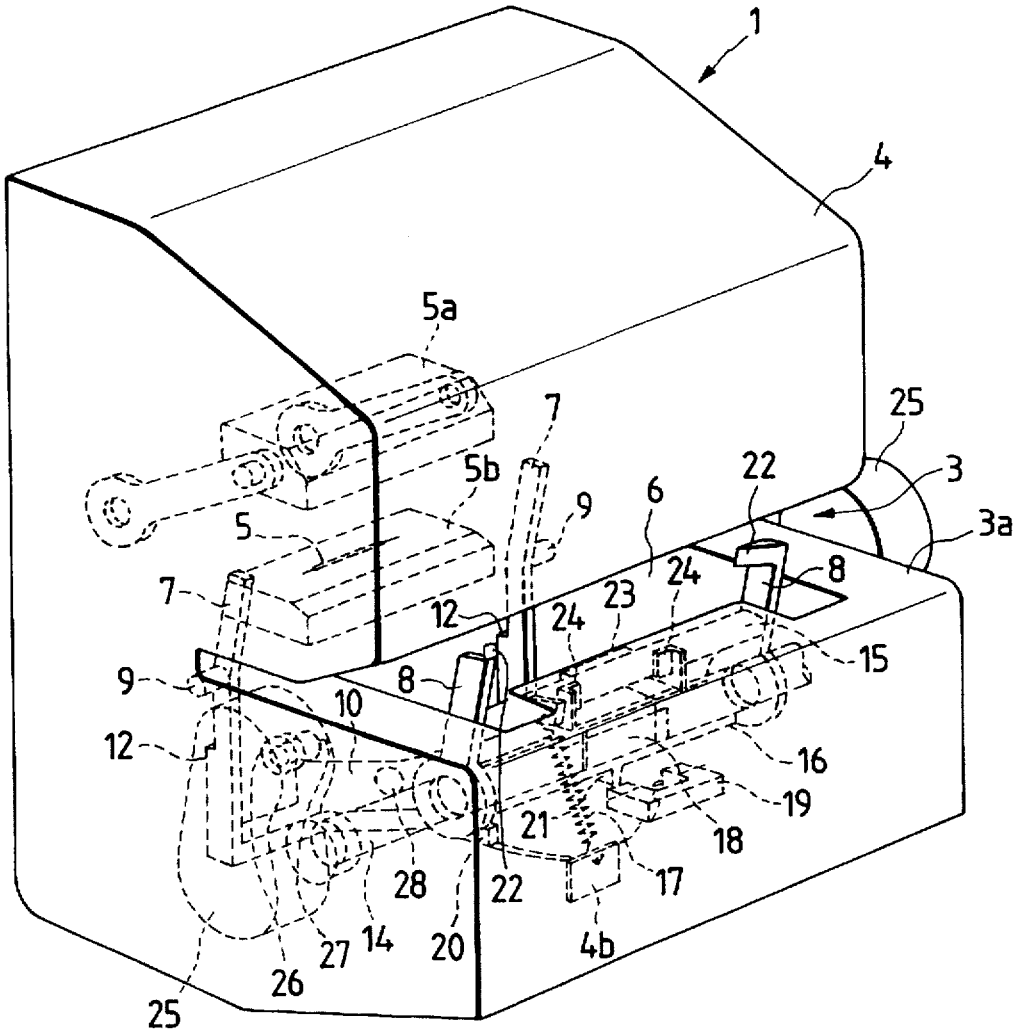
FIG. 5 is a perspective view thereof as viewed perspectively from the front side thereof with the oblique levers set in the upright position.

The shaft 14 is equipped with a lever control member 18 for regulating the rotational range of the oblique lever 8, and the lever control member 18 has two retaining pieces 23, 24. The retaining piece 24 is positioned on the entrance side of the slit 3, whereas the retaining piece 23 is positioned at the bottom of the slit 3. In other words, the two retaining pieces 23, 24 are arranged side by side along the direction in which the guide member 22 of the oblique lever 8 is moved. The coupling member 15 for coupling the oblique levers 8, 8 is position between the retaining pieces 23, 24. Consequently, though the oblique levers 8, 8 are pivotable with the respect to the shaft 14, a range of rotational angles at which the oblique levers 8, 8 are pivotable is restricted between the two retaining pieces 23, 24. The oblique levers 8, 8 urged by the coil spring 17 are stopped at a position where the coupling member 15 is brought into contact with the retaining piece 24 on the entrance side, that is, the position (or what is shown in FIG. 5) shown by the solid line of FIG. 3. When the bundle of sheets is inserted through the slit 3 in order that the guide member 22 is pushed by the bundle of sheets against the urging force of the coil spring 17, the oblique lever 8 is turned inward and stopped at a position where it is brought into contact with the retaining piece 23, that is, at the position shown by the imaginary line of FIG. 3.

A sensor 19 serving as a switch for operating the stapling unit 5 is fixedly installed via a fitting piece 4*c* in the body frame 4. The sensor 19 is positioned below the substantially central portion of the shaft 14 for supporting the oblique levers 8, 8. The sensor 19 comprises a light emitting element and a light receiving element which are spaced apart face to face as predetermined and when a light path therebetween is blocked, it outputs a detection signal. The stapling unit 5 operates on receiving the detection signal from the sensor 19.

The coupling member 10 of the parallel levers 7, 7 is provided with a leading end portion 20 directed to the oblique lever side 8. The coupling member 16 of the oblique levers 8, 8 is also provided with a leading end portion 21 directed downward. As shown by the imaginary line in FIG. 3, the sensor 19 detects the leading end portion 20 and outputs the detection signal when the parallel lever 7 pivots counterclockwise on the respective shafts 9. The sensor 19 detects the leading end portion 21 and outputs the detection signal when the oblique levers 8 pivots counterclockwise on the shaft 14. When the bundle of sheets 2 is inserted through the slit 3, the parallel lever 7 or the oblique lever 8 is rotated as described above and the sensor 19 outputs the detection signal. Further, the stapling unit 5 operates on receiving the detection signal from the sensor 19 and drives a staple into the bundle of sheets 2 in the slit 3.

The parallel and oblique levers 7, 8 thus function as those which operate as actuators for operating the stapling unit 5 by making the sensor 19 output the detection signal.

Figure 1:
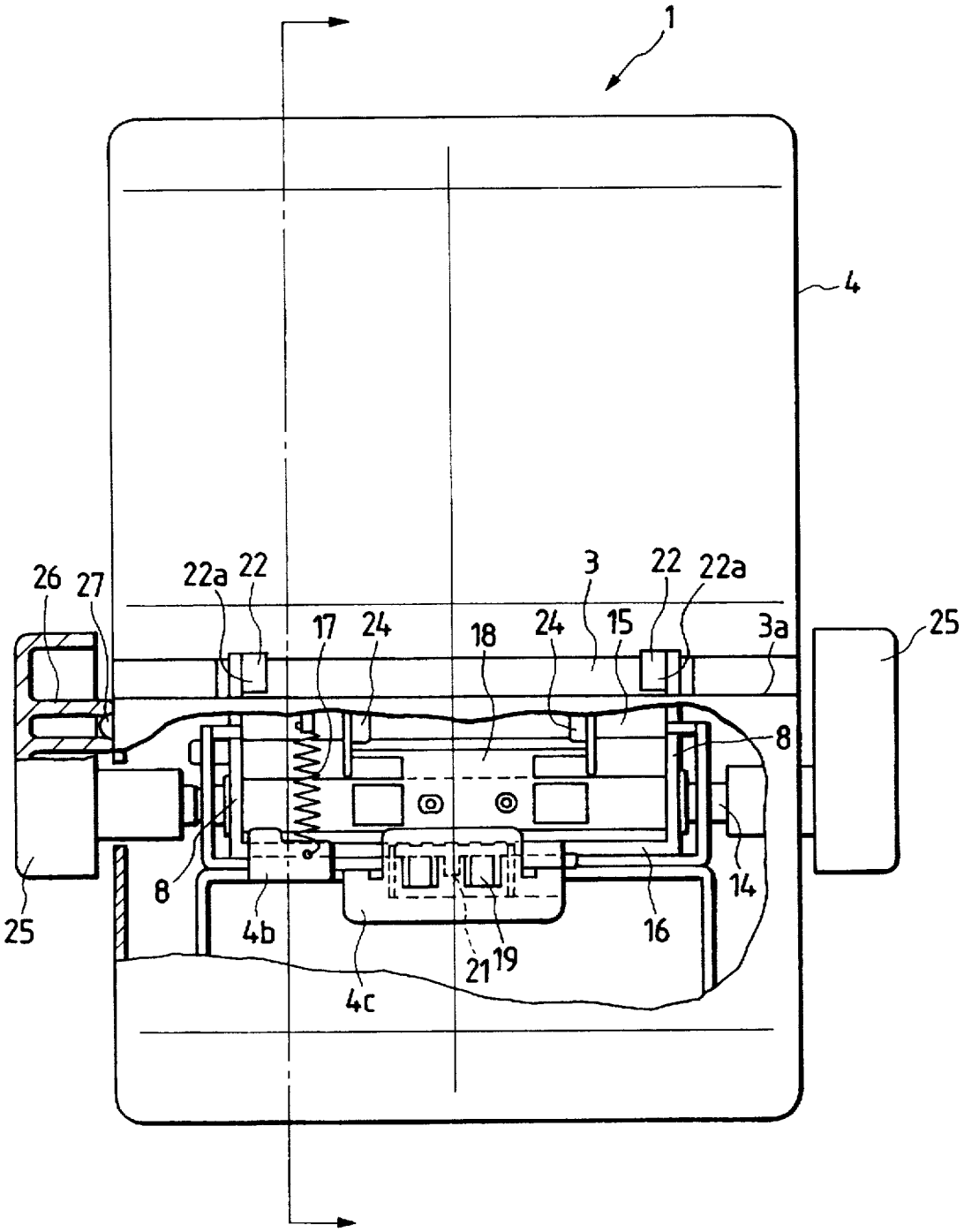
FIG. 1 is an elevational view of an electric stapler with oblique levers set in the upright position, according to the present invention.

Both ends of the shaft 14 for the oblique lever 8 are projected outward from the body frame 4 and fixedly fitted with the respective changeover levers 25, 25. When the changeover lever 25 is operated to turn the shaft 14, the oblique lever 8 can be set in either upright or turned-sidelong position. As shown in FIG. 1, a mating portion 26 is provided on one side of the changeover lever 25 which is kept in contact with the body frame 4. As shown in FIG. 4, further, mating projections 27, 28 engaging with the mating portion 26 of the changeover lever 25 are provided on the side of the body frame 4. The mating projections 27, 28 are placed side by side and spaced apart as predetermined along the locus drawn by the turning of the changeover lever 25. The mating projections 27, 28 are set apart at an angle of about 70 degrees in the direction of the rotation of the shaft 14.

In FIG. 1, the oblique lever 8 is in the upright position. At this time, the fore-end of the changeover lever 25 is directed upward and the mating portion 26 is engaging with the upper mating projection 27. When a surface extending outward from the body frame 4 is assumed in connection with the bundle-of-sheets loading surface 3*a*, the fore-end of the changeover lever 25 is projected upward from the extended surface. In other words, the guide member 22 of the oblique lever 8 is in the upright position in that it is projected upward from the bundle-of-sheets loading surface 3*a* when the fore-end of the changeover lever 25 is so set that it is projected upward from the extended surface of the bundle-of-sheets loading surface 3*a*.

In FIG. 4, the oblique lever 8 in the turned-sideling position. At this time, the fore-end of the changeover lever 25 is directed laterally (forward) and the mating portion 26 is engaging with the lower mating projection 28. The fore-end of the changeover lever 25 is situated below the extended surface of the bundle-of-sheets loading surface 3*a*. In other words, the guide member 22 of the oblique lever 8 is accommodated downward in the turned-sidelong position when the changeover lever 25 is set in a position lower than the extended surface of the bundle-of-sheets loading surface 3*a*. In FIG. 4, further, the peripheral portion of the changeover lever 25 is displayed on the right-hand side for convenience of explanation.

When the oblique stapling is conducted, the oblique levers 8, 8 and the guide members 22, 22 are set in the upright position. The changeover lever 25 is made to engage with the upper mating projection 27, and the shaft 14 is made unrotatable at this position. As shown by the solid line, the oblique lever 8 is set in the upright position and projected upward from the bundle-of-sheets loading surface 3*a*. The oblique levers 8, 8 pivoted on the shaft 14 are urged by the coil spring 17 and stopped when it is brought into contact with the retaining piece 24 of the lever control member 18.

As shown in FIG. 2, the corner portion of the bundle of sheets 2 is inserted through the slit 3 in the above state. The two edge sides 2*b*, 2*c* putting the corner portion therebetween are brought into contact with the guide surfaces 22*a*, 22*a* of the respective guide members 22, 22. While guiding the bundle of sheets 2, the guide members 22, 22 are pushed by the bundle of sheets 2 and turned counterclockwise in FIG. 3 against the urging force of the coil spring 17. As shown by the imaginary line of FIG. 3, the sensor 19 outputs the detection signal and operates the electric stapler 1 when the leading end portion 21 of the oblique lever 8 reaches the detection position of the sensor 19. In this case, the sensor 19 detects the leading end portion 21 before the coupling member 15 of the oblique levers 8, 8 is brought into contact with the retaining piece 23 of the lever control member 18. As shown in FIG. 2, a staple is driven-in at the position shown by an imaginary line S in the corner portion of the bundle of sheets 2 with respect to the two edge sides 2*b*, 2*c*.

When the oblique lever 8 is in the upright position, even though the parallel lever 7 rotates counterclockwise in FIG. 3 for some reason or other, thus causing the leading end portion 20 of the parallel lever 7 to move close to the sensor 19, the leading end portion 20 is brought into contact with the edge face of the leading end portion 21 of the oblique lever 8 and stopped before reaching the detection position of the sensor 19. Therefore, the sensor 19 is preventedfrom outputting the detection signal due to the malfunction of the parallel lever at the time the oblique stapling is attempted.

When the parallel stapling is conducted, the guide members 22, 22 of the oblique levers 8, 8 are set in the turned-sidelong position. When the oblique levers 8, 8 and the guide members 22, 22 are switched from the upright position to the turned-sidelong position, the changeover lever 25 is operated to turn the shaft 14 of FIG. 3 clockwise. With the operation of the changeover lever 25, the retaining piece 23 of the lever control member 18 is brought into contact with the coupling member 15, and the oblique lever 8 is turned to the predetermined position and stopped. The guide members 22, 22 is positioned below the bundle-of-sheets loading surface 3*a*, and the changeover lever 25 is also positioned below the extended surface of the bundle-of-sheets loading surface 3*a*. Consequently, a bundle of sheets 2 to be subjected to the parallel stapling is inserted through the slit 3 without being blocked by the guide member 22 and the changeover lever 25.

In FIG. 4, the bundle of sheets 2 is inserted through the slit 3 in such a posture that the surface and linear front edge side 2*a* of the bundle of sheets 2 are set perpendicular to the paper surface in FIG. 4. The parallel levers 7, 7 are brought into contact with the edge side 2*a* of the bundle of sheets 2 at two placed. While the edge side 2*a* of the bundle of sheets 2 is not set oblique and besides the parallel levers 7, 7 are kept in contact with the edge side 2*a* of the bundle of sheets 2 at two places, the bundle of sheets 2 is inserted through the slit 3. While guiding the bundle of sheets 2, the parallel levers 7, 7 are pushed by the bundle of sheets 2. The parallel levers 7, 7 are turned counterclockwise against the urging force of the coil spring 11 in FIG. 4 and the edge side 2*a* of the bundle of sheets 2 is allowed to enter deeper than the stapling position of the stapling unit 5. When the leading end portion 20 of the parallel lever 7 reaches the detection position of the sensor 19, the sensor 19 outputs the detection signal, thus causing the electric stapler 1 to operate. A staple is driven-in parallel to and in the proximity of the edge side 2*a*.

According to this embodiment of the invention, the state in which the parallel stapling is conducted can be switched immediately to the state in which the oblique stapling is conducted only by moving the guide members 22, 22 for oblique stapling upward with the changeover lever 25; that is, the switching operation is extremely simple. Since the guide members 22, 22 are fixedly provided for the electric stapler and not detachable parts, the missing problem as in the case of a special adaptor for use in the aforementioned conventional electric stapler becomes solvable.

Since the common sensor is used to detect the operation of the parallel lever 7 as an actuator for the parallel stapling and that of the oblique lever 8 as an actuator for the oblique stapling, the control system is simplified in comparison with what is equipped with a separate sensor.

Since the oblique lever 8 for the oblique stapling is provided with the guide member 22 for guiding the edge side of the bundle of sheets, stapling can be conducted always in the predetermined position of the corner portion of a bundle of sheets only by bringing the edge side of the bundle of sheets into contact with the guide member 22 and inserting the bundle of sheets through the slit 3.

When the oblique lever 8 for the oblique stapling is set in the upright position, moreover, the changeover lever 25 is projected upward from the loading surface of the bundle of sheets. When it is attempted to insert the bundle of sheets through the slit 3 in the parallel stapling posture by mistake, the malfunction caused by driving a staple in a position other than the corner portion of a bundle of sheets is prevented because the edge side is brought into contact with the changeover lever 25 and unable to contact the parallel lever.

When the oblique lever 8 is set in the upright position by the changeover lever 25, the sensor detects only the oblique lever 8 and remains unable to detect the parallel lever 7 structurally. Thus, such a malfunction as mentioned above can be prevented.

Figure 6:
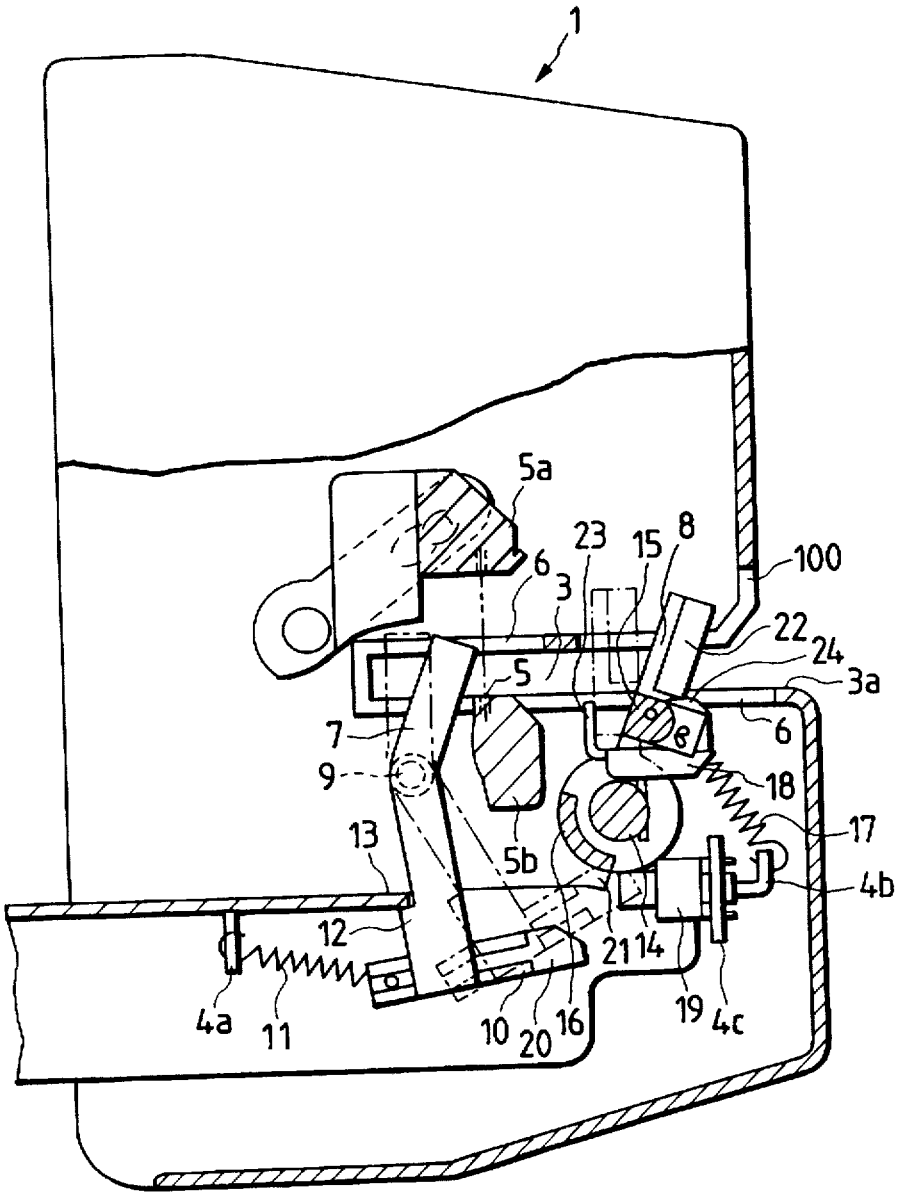
FIG. 6 is a sectional view of another embodiment of the present invention as viewed from the left-hand side with the oblique levers set in the upright position.

A description will subsequently be given of a second embodiment of the present invention by reference to FIG. 6. In FIG. 6, like reference characters designate like and corresponding component parts of FIG. 3 and the description thereof will be omitted for the simplification of the description. According to the embodiment of the invention shown in FIG. 3, sheets of paper be inserted in the stapling unit from above the guide member 22 of the second actuator, and the sheets of paper may be inserted like that by mistake. In the electric stapler shown in FIG. 6, on the other hand, the guide member 22 is fitted in a groove 100 formed in the body frame 4 when the oblique lever 8 as a second actuator is uprighted, whereby no slit large enough for the paper to be inserted in the staple unit 5 is produced above the guide member 22. It is therefore possible to feed the paper deeper by mistake.

According to a first aspect of the present invention, there is no possibility that the special detachable adaptor as a component part provided separately from the stapler body is missing. When the oblique stapling is conducted, a staple can be driven-in accurately in the predetermined position of the corner portion of the sheet.

According to a second aspect of the present invention, the control system of the staple means can be simplified in construction.

According to a third aspect of the present invention, it is ensured that the malfunction caused by operating the actuator for the parallel stapling when the oblique stapling is conducted.

According to a fourth aspect of the present invention, the sheets will not be fed toward the first actuator even if it is attempted to feed the sheets into the actuator for the parallel stapling at the bottom of the slit when the oblique stapling is conducted because the whole sheet loading passage is blocked by the second actuator in the thickness direction of the sheets to ensure that the malfunction is prevented.

According to a fifth aspect of the present invention, the paper is blocked by the lever with the paper inserted parallel to the slit when the oblique stapling is conducted and the second actuator is unable to actuate the switch, whereby the malfunction of the staple means is prevented.

What is claimed is:

1. An electric stapler for stapling the sheets, comprising:

staple means having a sheet guide surface on which the sheets are conveyed, for stapling the sheets thus conveyed in a stapling position;

a first actuator protruding in part from the sheet guide surface, having a switch wherein, when the first actuator comes into contact with more than one place of one edge side of the sheets conveyed beyond the stapling position and moved by the sheets being conveyed, the first actuator actuates the switch so as to operate the stapling means; and a second actuator positioned upstream the first actuator, a part of the second actuator selectively protruding and retracting with respect to the sheet guide surface, having a switch wherein, when the second actuator comes into contact with predetermined lengths of different edge sides constituting a corner portion of the sheets being conveyed beyond the stapling position while the part protruding in part from the sheet guide surface and moved by the sheets being conveyed, the second actuator actuates the switch so as to operate the stapling means.

2. The electric stapler according to claim 1, wherein a common switch is used for the switch of the first actuator and the switch of the second actuator.

3. The electric stapler according to claim 2, wherein the second actuator has blocking means for preventing the first actuator from actuating the common switch when the part of the second actuator protrudes from the sheet guide surface.

4. The electric stapler according to claim 1, wherein the sheet guide surface has a sheet loading passage whose opening is vertically wide enough for stacked sheets having predetermined thickness to be inserted therethrough; and when the part of the second actuator protrudes from the sheet guide surface, the second actuator blocks the sheet loading passage in the thickness direction of sheets to be inserted along the sheet loading passage.

5. The electric stapler according to claim 1, further comprising:

a lever provided on an outside surface of the sheet guide surface, for switching positions of the second actuator with respect to the sheet guide, wherein the part of the second actuator is protruded from the sheet guide surface when the lever protrudes from an extending surface of the sheet guide surface, the part of the second actuator is not protruded from the sheet guide surface when the lever does not protrude from the extending surface of the sheet guide surface, and during the lever protruding from the extending surface of the sheet guide surface, an edge side of the sheets is brought into contact with the lever prior to the second actuator when the sheets are conveyed toward the second actuator such that the edge side is set substantially perpendicular to a conveying direction so as to prevent the switch from being actuated by the second actuator.

6. The electric stapler according to claim 1, wherein the stapling position is provided between the first actuator and the second actuator.

* * * * *